US006196496B1

(12) United States Patent
Moskovitz et al.

(10) Patent No.: US 6,196,496 B1
(45) Date of Patent: Mar. 6, 2001

(54) METHOD FOR ASSIGNING A TARGET TO A MISSILE

(75) Inventors: Yigal Moskovitz; Izhak Saban, both of Kiryiat Haim; Rami Fabian, Haifa, all of (IL)

(73) Assignee: State of Israel Ministry of Defense Armament Development Authority Raeael, Haifa (IR)

( * ) Notice: Subject to any disclaimer, the term of this patent is extended or adjusted under 35 U.S.C. 154(b) by 0 days.

(21) Appl. No.: 09/106,603

(22) Filed: Jun. 29, 1998

(51) Int. Cl.[7] ..... F41G 7/00

(52) U.S. Cl. ..... 244/3.15; 244/3.11; 244/3.16; 244/3.19; 342/62; 89/1.11

(58) Field of Search ..... 244/3.1, 3.11, 244/3.13–3.17, 3.19, 3, 2; 89/1.11; 342/61, 62, 63, 67

(56) References Cited

U.S. PATENT DOCUMENTS

| | | | | |
|---|---|---|---|---|
| 4,848,208 | * | 7/1989 | Kosman | 89/1.11 |
| 5,042,743 | * | 8/1991 | Carney | 244/3.11 |
| 5,206,452 | * | 4/1993 | Stamper et al. | 89/1.11 |
| 5,855,339 | * | 1/1999 | Mead et al. | 244/3.11 |

FOREIGN PATENT DOCUMENTS

WO 96/08688 3/1996 (WO) ..... F41G/7/00

OTHER PUBLICATIONS

Bar–Shalom, Yaakov and Thomas E. Fortmann, "Tracking and Data Association", Academic Press, Inc., Boston, chapter 3 and chapter 4, pp. 101–141, 1988.

Duda, Richard O. and Peter E. Hart, "Pattern Classification and Scene Analysis", A Wiley–Interscience Publication, chapter 6, pp. 189–260, 1973, New York.

* cited by examiner

*Primary Examiner*—Bernarr E. Gregory
(74) *Attorney, Agent, or Firm*—Wolf, Greenfield & Sacks, P.C.

(57) ABSTRACT

A method for assigning a target within a cluster of targets to a specific one of a plurality N of weapons launched from M airplanes is provided. The method includes providing the specific weapon with an index (m,n) based on the weapon bay n and the airplane m from which it is to be launched, receiving the central location and determining the shape of the cluster; dividing the cluster shape into N sub-clusters wherein each sub-cluster n has M sectors m, determining the center of gravity of each sector; associating the specific weapon with the sector having index (m,n); and assigning a target from among the targets in the associated sector to the specific weapon.

13 Claims, 5 Drawing Sheets

METHOD FOR ASSIGNING A TARGET TO A MISSILE

FIELD OF THE INVENTION

The present invention relates to methods and apparatus for finding and bombing a cluster of targets.

BACKGROUND OF THE INVENTION

In combat operations, it is often necessary to target and destroy one or more members of a cluster of ground targets located deep behind enemy lines. For example, it may be desired to destroy an artillery or missile battery made up of a number of artillery pieces or missile launchers and one or more support vehicles, or a column of tanks which may either be camped and thus stationary or moving along an axis.

Various methods are available for effectively handling such targets. Perhaps the most effective method known heretofore is using combat aircraft which overfly the targets, identify and locate the target and then launch one or more of a variety of bombs and missiles to destroy the targets.

A disadvantage of such techniques is that they require a manned attacking aircraft to fly deep into enemy territory which can be dangerous to the aircraft and crew.

An alternative solution is the use of ground-to-ground or air-to-ground missiles. These missiles have accuracies which are at least as good as those attained by projectiles launched from manned aircraft and have the advantage of not incurring undue risk to attacking personnel. However, these missiles are very expensive, which makes them practical only for extremely sensitive or valuable targets.

Applicants' copending Israeli application 110960 describes a system for bombing one or more member of a cluster of targets. The system includes an aircraft and a multiplicity of bombs and determines the location of a cluster of targets, selects a target for each of the bombs and transmits the information to the missiles or bombs. Each missile or bomb then utilizes pattern recognition means to navigate towards the target.

Reference is now briefly made to FIG. 1 which very generally illustrates the flight of a group of aircraft with missiles thereon for bombing a battery of targets. As shown in FIG. 1, a number of airplanes 10, each of which has a set number of weapons 12 to be launched, approach an area of interest 20 in which number of batteries 22 to be bombed is thought to exist. Typically, each battery 22 comprises a plurality of targets 24. The airplanes 10 launch their weapons 12 at a distance from the area 20 and return home. The weapons 12, which typically include theron homing systems (not shown), make their way towards the area of interest 20.

Unfortunately, when many missiles are launched towards the same battery, they may all attack the same target, rather than attacking the different targets within the artillery or missile battery. Still further, the missiles do not update the location of the battery from the time it is first viewed to the time it is bombed and thus, if the battery has moved, the weapons will not explode on the desired target.

SUMMARY OF THE PRESENT INVENTION

It is an object of the present invention to provide a method for finding and bombing a stationary or moving cluster of targets. The method operates on a number of airplanes, each of which has a set number of weapons to be launched, each with their own guidance system thereon.

There is therefore provided, in accordance with a preferred embodiment of the present invention, a method for assigning a target within a cluster of targets to a specific one of a plurality N of weapons launched from M airplanes. The method includes the following steps:

- providing the specific weapon with an index (m,n) based on the weapon bay n and the airplane m from which it is to be launched;
- receiving the central location and determining the shape of the cluster;
- dividing the cluster shape into N sub-clusters wherein each sub-cluster n has M sectors m;
- determining the center of gravity of each sector;
- associating the specific weapon with the sector having index (m,n); and assigning a target from among the targets in the associated sector to the specific weapon.

Additionally, in accordance with a preferred embodiment of the present invention, the method can be performed by each of the launched weapons or by the airplane prior to launching its weapons.

There is also provided, in accordance with a second preferred embodiment of the present invention, a method for finding a cluster of targets. The method includes the step of scanning an area of interest in the general vicinity of a cluster a number of times. Each time, the sensor scans across the direction of flight fast enough to finish a sweep before the vehicle flies the distance covered by the footprint of the sensor of the ground. The range from the vehicle to the terrain is generally constant for each scan and is only changed between scans. The method also includes the steps of estimating, from the output of the step of scanning, an estimated location and shape of the cluster, scanning an area generally covering the estimated shape and location of the cluster and identifying a detailed location and shape of the cluster.

Moreover, in accordance with a preferred embodiment of the present invention, the method includes the steps of comparing the shape of the cluster to a reference image of the cluster and selecting a target from among the objects in the cluster. The step of comparing preferably includes the step of forming a three-dimensional polygon from the outer objects in the cluster. In addition, the method includes the step of generating differences between the produced three-dimensional polygon at one time to the produced three-dimensional polygon at a second time and determining if the differences indicate motion of at least one object in the customer. Typically, the three-dimensional polygon is produced by performing a Hough transform on the sensor data output from the scan of the area of the cluster.

Additionally, the sensor can be electro-optic or electromagnetic and the reference image can be received during or prior to flight.

Finally, in accordance with a preferred embodiment of the present invention, the method additionally includes the step of selecting a target from among the identified objects in the cluster. The step of selecting preferably includes the step of reconstructing the terrain and considering the terrain shape when determining the selected target.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
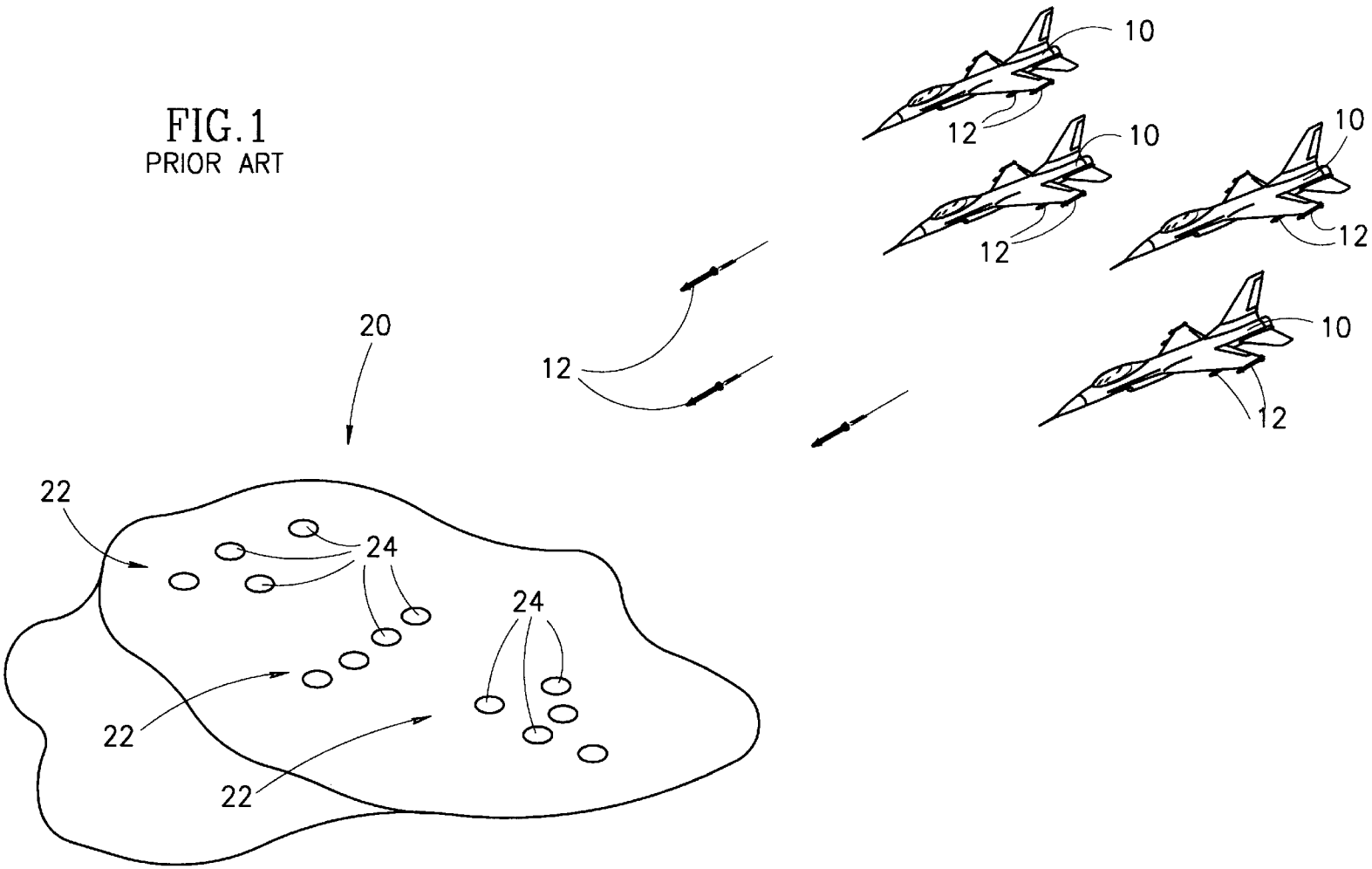
FIG. 1 PRIOR ART
FIG. 1 is a schematic illustration an approaching group of airplanes to a targeted area of interest, as described formerly.
Figure 2:
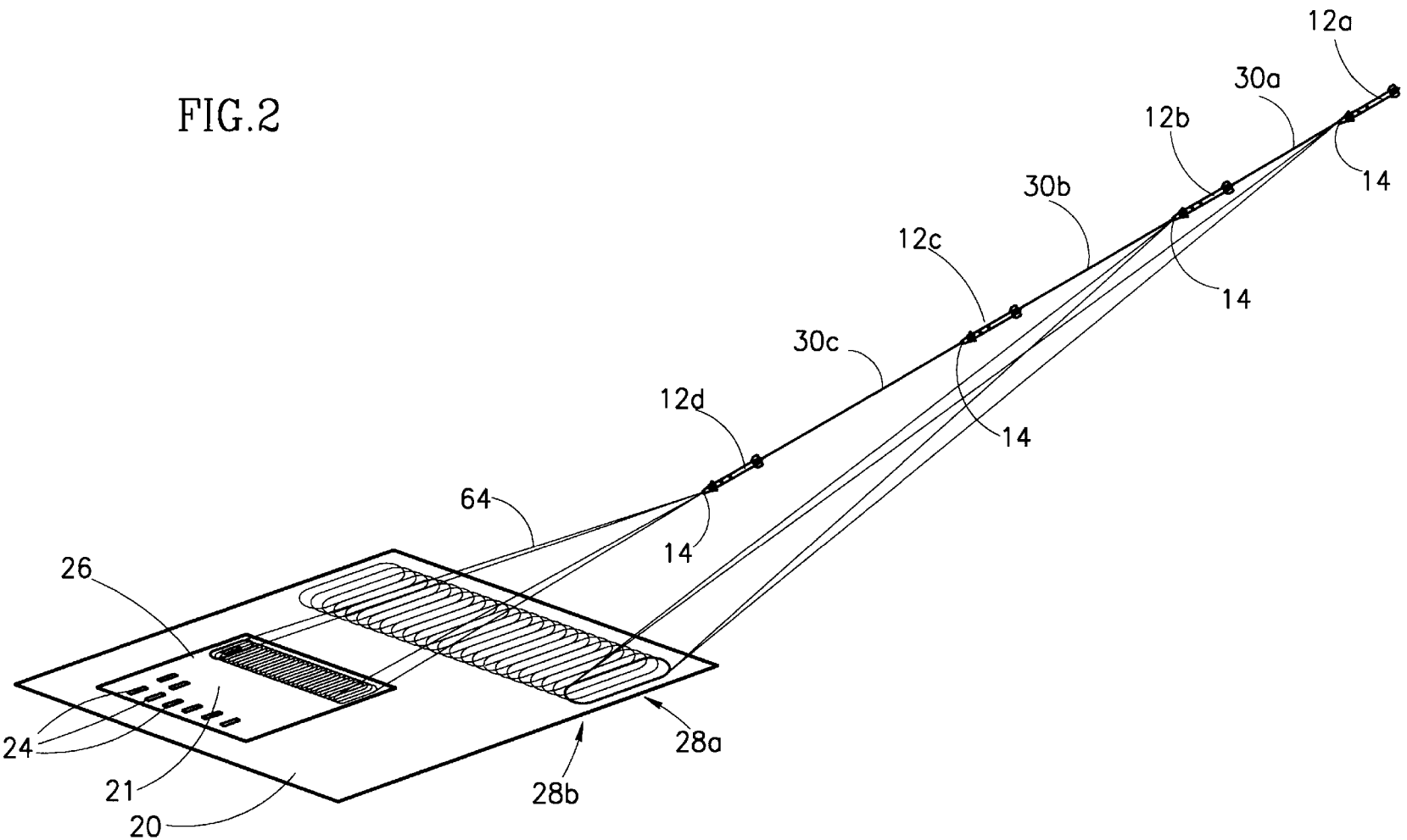
FIG. 2 is a schematic illustration of a single airplane, of the group of airplanes of FIG. 1, scanning the area of interest as it approaches the area, in accordance with the method of the present invention.
Figure 3:
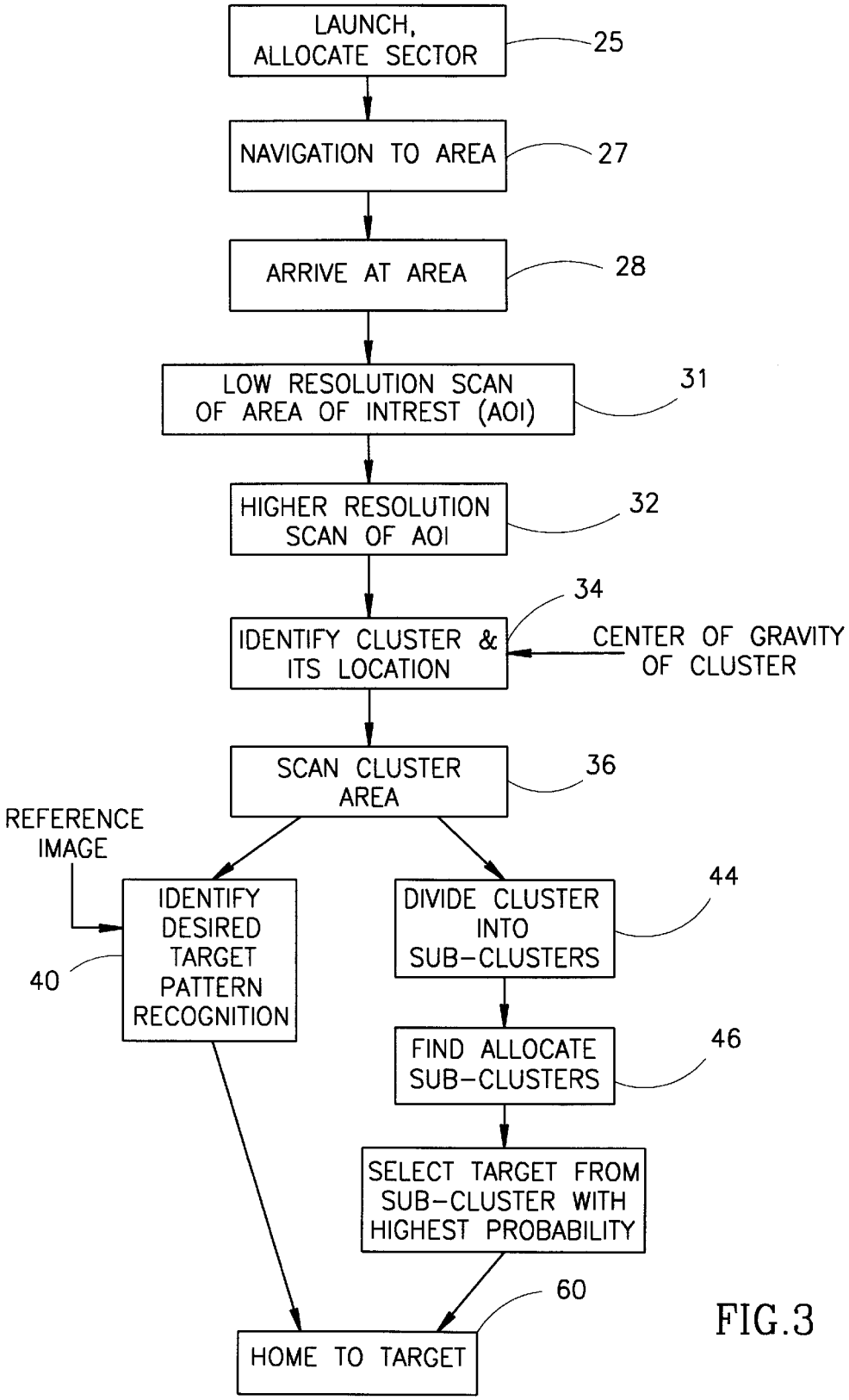
FIG. 3 is a flow chart illustration of the method of the present invention.
Figure 4:
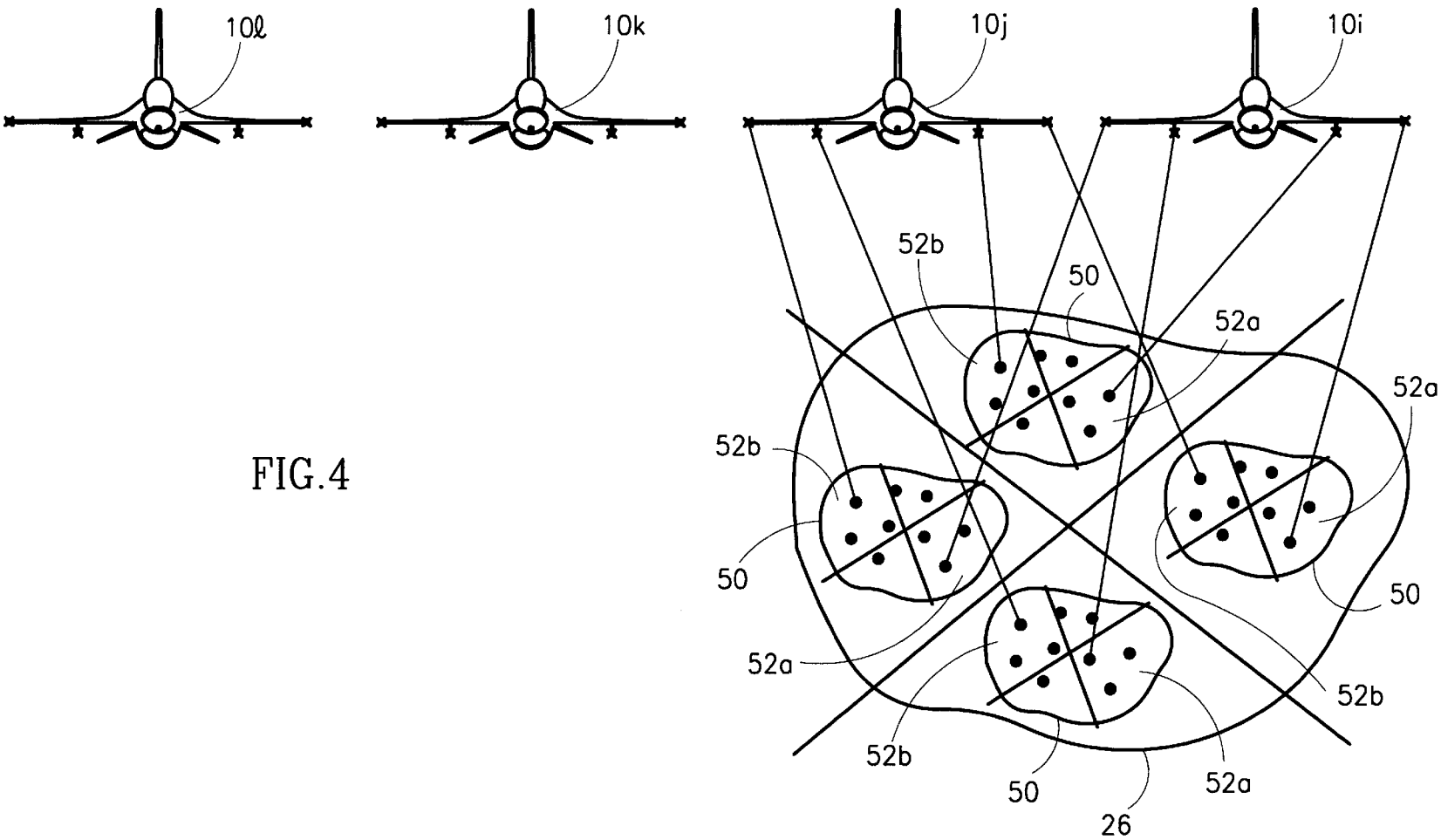
FIG. 4 is a schematic illustration useful in understanding the cluster dividing operation of the present invention.
Figure 5:
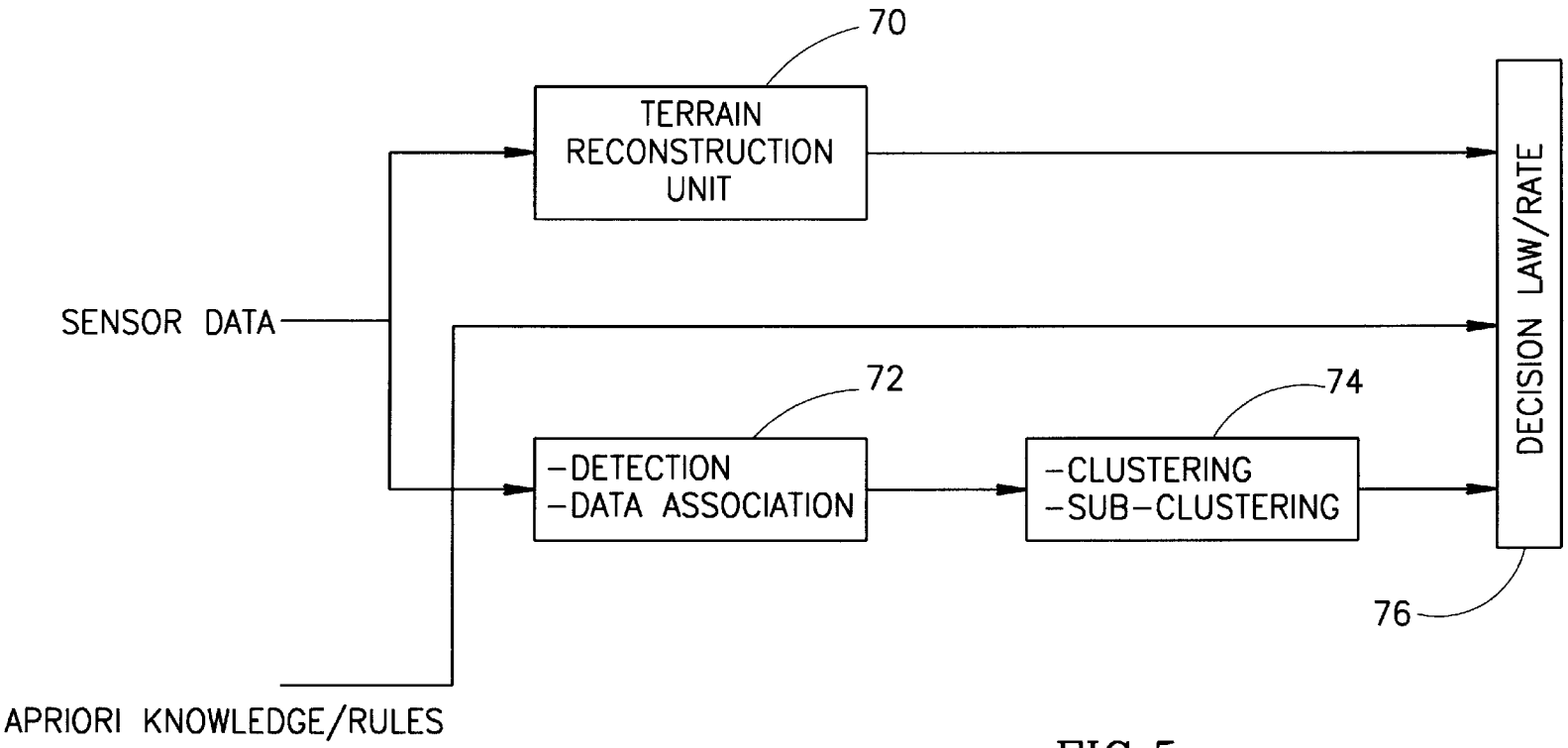
FIG. 5 is a block diagram illustration of a system for determining which target to bomb.

Reference is now made to FIGS. 2 and 3 which illustrate a search method, operative in accordance with the present invention, for identifying a cluster of targets, to FIG. 4 which illustrates a method for dividing the targets within the cluster among the available weapons and to FIG. 5 which illustrates a system for determining which target to bomb.

Each weapon 12 comprises a seeker 14, for viewing the area of interest 20 at a close range, and a target determining system (not shown) for determining which target to bomb. As will be described hereinbelow, the target determining system selects a target for its weapon as a function of which airplane i of the group of airplanes the weapon was on and of the bay j in the weapons bay of the airplane in which the weapon was located.

When a weapon such as 12 comes within range of the area 20 of interest, its seeker 14 scans area 20 a number of times as detailed hereinbelow, looking for clusters 21 of targets 24. Each target determining system separately identifies the clusters 21 and then selects, according to predefined criteria, the target 24 within the clusters to which its weapon 12 is to be directed. The predefined criteria separate the cluster area 26 (the area surrounding the identified cluster or clusters) into subclusters, as described hereinbelow, and associate the weapon with an appropriate one of the subclusters as a function of the airplane and bay (i, j) on which it was originally flown. The subcluster association is described in more detail hereinbelow with respect to FIG. 4. As can be seen in FIG. 4, each one of the weapons 12 of an airplane 10 is directed toward a separate subcluster, therefore, these weapons are not likely to bomb the same targets.

FIGS. 2 and 3 illustrate the method by which each target determining system finds clusters 21 and allocates targets 24. FIG. 2 illustrates one weapon 12 approaching an area of interest 20 and FIG. 3 illustrates, in flow chart format, the operations performed as the weapon flies.

At launching (step 25), the airplane 10 provides each of its weapons 12 with the general location of the area 20 of interest, its airplane number from among the group of airplanes and the bay in which each weapon 12 originally was stored. Each weapon then navigates (step 27), through its guidance system (not shown), to the area 20 of interest.

The approach of one weapon to the area 20 of interest is shown in FIG. 2. When the weapon, initially labeled 12*a*, arrives at area 20 (step 28) to within the viewing range of its seeker 14, its seeker 14 scans the area (step 31) with an electro-magnetic or electro-optic sensor. The result of the scan is a map of the objects within the area 20. The map includes the locations of the objects and probabilities that the objects are "real" objects, as opposed to artifacts of the scanning. Since the weapon in position 12*a* is still relatively far from the area of interest, the resolution of the scan is low and the probabilities for all objects are low.

During this first scan, when the weapon 12 is fairly far from the cluster location, the line of sight 30*a* of the seeker 14 is initially set to view the closest line of the area of interest 20. The seeker 14 sweeps the sensor back and forth, in front of the weapon 12, so as to sweep across a row of the area of interest. As can be seen in FIG. 2, the sensor views a conical portion of the world which has an elliptical footprint when intersected with the terrain. Because of the conical viewing section, the location of each object on the ground is defined with three parameters, azimuth, elevation and range.

As the weapon 12 flies towards the area of interest 20, the seeker 14 scans rows in such a way as to maintain the range to and within each row generally the same. Thus, initially row 28a is scanned, then as the weapon 12 moves forward, row 28*b* is scanned, etc. Once the weapon has covered enough ground, such that the area of interest 20 has been fully scanned, the line of sight 30*b* of the seeker 14 is reset to the beginning of the area of interest (i.e. to scan row 28*a*). The weapon position is now labeled 12*b* and the scanning of the area is then repeated (step 32), with a shorter range, as the weapon 12 flies even closer. This scan is of higher resolution and the resultant probabilities of detection are higher since the weapon is much closer to the area of interest 20.

From the elevation and location data of the two scans, from a previously received "reference image" of the cluster area (such as might have been taken from a satellite or from a previously flown airplane), and/or from any other a priori inertial information about the cluster, such as its general location, the cluster is identified (step 34) and its location more clearly defined, as described in more detail hereinbelow. Typically, this involves defining its location as being that of the "center of gravity" of the targets of the cluster. The weapon position is now labeled 12*c*.

In step 36, weapon position 12*d*, the line of sight 30*c* of the seeker 14 is set to the beginning of the area 26 of the cluster and the scanning is repeated, this time only to cover the general area 26 of the cluster. As before, the area 26 of the cluster is scanned at least twice.

From the data of the scans, the specific locations of the targets 24 in the cluster 21 are determined, as described hereinbelow. The target determining system has two modes the choice of which depends on the type of targets to be bombed. If the target is a specific target which happens to be within a group of objects, for example, a control unit within a surface-to-air battery, the specific target is identified from within the cluster (step 40) and the weapon 12 is set (step 60) to home in on the target.

If the entire cluster, for example, a convoy of tanks, it to be bombed then, in step 44, each target determining unit divides the cluster 21 into subclusters 50, as shown in FIG. 4. The number of subclusters is determined by the number N of weapons 12 per airplane 10. Each target determining unit then divides each subcluster 50 into 52*a*, 52*b* . . . according to the number M of airplanes 10 which carry weapons. In step 46, the target determining unit selects the section (m,n), where m denotes the subcluster and n denotes the section, which matches the airplane and bay parameters (i, j) of the weapon 12. In other words, the weapon from the $3^{rd}$ bay of the fourth airplane will bomb the third section of the fourth subcluster. In another example, four airplanes 10*i*, 10*j* 10*k* and 101 launch four weapons 12 each. The weapons from airplane 10*l* are assigned to the section 52*a* of each subcluster 50, and the weapons of the second airplane 10*j* are assigned to the section 52*b* of each subcluster 50.

Since the method of dividing the clusters is defined a priori according to weapon and airplane number, there is no need for communication between the weapons over which will bomb which targets. This reduces the problem of multiple hits on one target.

Once the sections 52*a*, 52*b* . . . and subcluster 50 have been selected, the target determining unit selects (step 48) a target from with the selected section. The target determining unit then proceeds to step 60 to home in on the target.

It will be appreciated that the seeker 14, weapons 12 and guidance system can be of any suitable type known in the art.

The method of FIG. 3 will now be described in more detail. The steps 31, 32 and 36 of scanning are performed by the seeker 14. The seeker 14 is gimbaled such that it can view a row which is perpendicular to the direction of motion and at a generally fixed range. To that end, both azimuth and elevation are continually changed as a function of the relative geometry of the speed of the weapon and the viewing area width. In the present invention, the time to scan a row should not surpass time in which a weapon such as 12*a* moves forward further than the amount of the ground viewed in one scan.

The shape of the footprint which is viewed is a function of the conic viewing area and the shape of the ground being viewed. Typically, and as shown in the Figures, the footprint is elliptical. If the footprint is 330 meters in the direction of flight of the weapon 12, the scan time is 1.5 sec and the weapon 12 moves 210 meter/sec, the scan can finish in time.

At each moment, the seeker 14 measures the strength of the signal reflected from the ground and determines the distances to each object found and the probabilities associated therewith. The shape of the footprint has to be taken into account utilizing methods known in the art, when determining the distance of any object to the weapon. The methods of identifying objects and assigning probabilities thereto are described in the book *Tracking and Data Association*, by Y. Bar-Shalom and T. E. Fortmann, Academic Press, inc., 1987. The book is incorporated herein by reference.

The system of the present invention stores the locations of those objects whose probability of being a significant object is above a predetermined threshold. From these object locations, a "map" or image of the targets in the area 20 of interest is made. The map is updated, as described hereinbelow, whenever the seeker 14 scans a section of the area 20 of interest which as already been scanned. The probabilities associated with objects which are repeatedly identified are increased. Because of the repeated scans, the number of false identifications of objects is reduced.

If the area of interest is "topographically busy" (i.e. lots of hills and valleys behind which the targets can hide), it may be desirable to create a map of the terrain. In this embodiment, as shown in FIG. 5 to which reference is now briefly made, the scan data is provided to both a terrain reconstruction unit 70 and a detection and data association unit 72. The terrain reconstruction unit 70 utilizes the scan data to determine the terrain shape and the detection and association unit 72 utilizes the scan data to determine which objects are possible targets, as described hereinabove. The output of the detection unit 72 is a series of possible targets which is provided to a clustering unit 74 for determining the locations of clusters 21 and for separating the identified clusters into subclusters and sections. The output of clustering unit 74 and of the terrain reconstruction unit 70 is combined, in a decision law unit 76, with a priori terrain knowledge and/or rules regarding typical behavior of targets, to determine which of the highly probable objects should be selected as targets.

It will be appreciated that the scanning steps 31, 32 and 36 have to be finished to allow enough time for the target to be assigned, for weapon 12 to lock onto its assigned target and then to fly towards it. For example, if step 31 begins about 5000 meters from the area of interest 20, step 32 might begin around 4000 meters from the area of interest 20. Step 36 would have to be finished by the time the weapon 12 is about 2600 meters from the cluster area 26.

The updating of the map is performed in two ways. For each scan, the approximate inertial location of each object of interest is determined and stored. However, due to the overlapping of the scans, the different sizes of objects caused by the different lines of sight and the errors in determining inertial location, the same object will not appear at exactly the same location from scan to scan. Therefore, a tracking system is utilized to associate an object found in one scan with the same object found in another scan. Such a tracking system is described in the book *Tracking and Data Association*, as cited above.

In step 34, the inertial map is reviewed to determine if there are any objects which are clustered together and if so, the location of the cluster is defined as the "center of gravity" of the objects in the cluster. Clustering techniques are described in the book Pattern Classification and Scene Analysis, by O. R. Duda and P. Hart, John Wiley and Sons, 1973. The book is incorporated herein by reference.

The location of the cluster should approximately match the expected location of the cluster, as defined by external information or from the radar information provided by the airplane. Once the cluster location has been determined, the remaining objects in the inertial map are ignored. By concentrating only on the cluster location, the number of false object identifications is reduced.

From the inertial map, the shape of the cluster, as a polygon, is determined. The points of the polygon are defined by their elevation, range and azimuth. The polygon is produced by first performing a Hough transform on the locations of the objects 9 (the objects are defined as points rather than as spots). Afterwards, the outermost lines are connected together to form the three-dimensional polygon. The three-dimensional polygon can be projected two-dimensionally by compensating for the range; the two-dimensional projection of the cluster should approximately match that of the reference image.

The data from the step 36 of the cluster area is compared to the shape map produced in step 34. If the polygonal shape of the cluster has changed, the direction of the movement is determined from the differences in shape. From this, it can be determined if the entire cluster is moving (for the most part, a translation of the shape) or if only a few of the objects of the cluster are moving (a significant shape change). The target determining unit then determines if it wants to track the moving objects or if it wants to select a stationary target for bombing. Furthermore, the target determining system may determine that the targets to be chosen are those that have moved, since movement indicates that the targets are real.

In step 44 (for attacking multiple targets), the cluster is divided up into subclusters, as a function of the number N of weapons 12 launched per airplane and the number M of airplanes launching targets. The lines by which the cluster is divided depend on which targets 24 are close together and the cumulative probabilities of detection of the groups of targets. To determine the closeness of targets 24, a nearest-neighbor filter, as is known in the art and as described in the book *Tracking and Data Association*, as cited above, is utilized. Step 44 also includes determining the location of the center of gravity of each sub-cluster. The book *Pattern*

*Classification and Scene Analysis*, as cited above, describes a suitable method of subclustering and division of the area.

In step 46, the sub-cluster allocated for each specific weapon such as 12 is found. In step 48 the following information is determined: the center of gravity of the sub-cluster, the probability of detection of the allocated target, the geometrical feature of the target as determined by the seeker 14 during the previous scans, the inertial location of the target and the shape of the cluster (or sub-cluster) at the time of allocation. In step 60, the weapon such as 12*a* homes to the center of gravity of the assigned sub-cluster 50, changing to homing onto a specific target only once the weapon 12*a* is close enough to determine that the probability that the target is a real object is high.

Step 40 for attacking a desired target from among the targets of a cluster can be described as follows: The shape of the cluster in which the desired target is located and any features of the desired target are determined with reference to an externally provided reference image. Once the weapon 12*a* gets close enough to the target for the features to become identifiable, the guidance system 16 begins searching for the desired target. The guidance system 16 identifies the desired target according to any suitable identification technique, such as a least squares calculation between the reference image and the received reference image. At the same time, the guidance system 16 determines a transformation between the reference image and the received image, both in the inertial plane and within the shape of the cluster, such that maximal probabilities of detection are produced.

It will be appreciated the steps 25–48 can be performed on an airplane, utilizing a radar system rather than a seeker 14, prior to launching its weapons. The allocated target and its subcluster and section location, for each weapon, are provided to the appropriate weapon, at which point, the weapon homes to the assigned target.

It will be appreciated by persons skilled in the art that the present invention is not limited to what has been particularly shown and described hereinabove. Rather the scope of the present invention is defined by the claims which follow:

What is claimed is:

1. A method for assigning a target within a cluster of targets to a specific one of a plurality N of weapons launched from M airplanes, the method comprising the steps of:

providing said specific weapon with a weapon index (m, n) based on a weapon bay n and an airplane m from which it is to be launched;

determining a central location of said cluster of targets and determining a shape of said cluster;

determining a center of gravity of each said shape of said cluster;

dividing said shape of said cluster into N sub-clusters wherein each sub-cluster n has M sectors m and each sector has a sector index (m, n);

associating said specific weapon having said weaoon index (m,n) with said sector having said sector index (m, n); and assigning a target from among said cluster of targets in said associated sector having said sector index (m, n) to said specific weapon.

2. A method according to claim 1 which is performed by each of said specific weapons.

3. A method according to claim 1 which is performed by each airplane prior to launching its weapons.

4. A method according to claim 3 and also comprising, after the step of identifying, the steps of comparing said shape of said cluster to a reference image of said cluster, and of selecting a target from among one or more objects in said cluster.

5. A method according to claim 4 and wherein said step of comparing includes a step of forming a three-dimensional polygon from outer objects in said cluster.

6. A method according to claim 5 wherein said step of comparing includes a step of generating differences between said three-dimensional polygon at a second times and determining if said differences indicate motion of at least one object in said cluster.

7. A method according to claim 5 and wherein said step of forming includes a step of performing a Hough transform on data output from of said scanner from said second step of scanning.

8. A method according to claim 4 and wherein said reference image is received from a source external to said vehicle.

9. A method according to claim 8 and wherein said reference image is received during flight of said vehicle.

10. A method for finding a cluster of targets, the method performed by a flying vehicle and comprising the steps of:

determining at least an expected inertial location of said cluster of targets;

with a scanner in a vehicle, scanning an area of interest in a vicinity of said expected inertial location a number of times, wherein during each scan, said scanner scans across a direction of flight in less time than that required to finish a sweep before said vehicle flies a distance covered by a footprint of said scanner on the ground and wherein a range from said vehicle to the terrain is substantially constant for each scan and is only changed between scans;

estimating from an output of said step of scanning, an estimated location and an estimated shape of said cluster;

scanning with said scanner, at least once, an area covering substantially said estimated shape and said estimated location of said cluster; and identifying a more detailed location and shape of said cluster.

11. A method according to any of claim 10 and wherein said scanner is an electro-optic scanner or an electromagnetic scanner.

12. A method according to claim 10 and also comprising a step of selecting a target from among said one or more objects in said cluster.

13. A method according to claim 12 and wherein said step of selecting comprises the steps of reconstructing terrain and considering a terrain shape when determining said selected target.

* * * * *

UNITED STATES PATENT AND TRADEMARK OFFICE

CERTIFICATE OF CORRECTION

PATENT NO. : 6,196,496 B1 
DATED : March 6, 2001
INVENTOR(S) : Moskovitz, Yigal and Saban, Izhak It is certified that error appears in the above-identified patent and that said Letters Patent is hereby corrected as shown below:

Title page,
Item [75], Inventors, please delete "Yigal Moskovitz; Izhak Saban both of Kiryat Haim; Rami Fabian, Haifa, all of (IL)" and insert -- Yigal Moskovitz, Kiryat Bialik; Izhak Saban, Kiryat Haim; Rami Fabian, Haifa, all of (IL) --

Signed and Sealed this

Eighteenth Day of June, 2002

*Attest:*

*Attesting Officer*

JAMES E. ROGAN
*Director of the United States Patent and Trademark Office*